US010279943B2

(12) United States Patent
Uraoka

(10) Patent No.: US 10,279,943 B2
(45) Date of Patent: May 7, 2019

(54) BAG MAKING AND PACKAGING MACHINE

(71) Applicant: ISHIDA CO., LTD., Kyoto-shi, Kyoto (JP)

(72) Inventor: Shigenobu Uraoka, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 326 days.

(21) Appl. No.: 15/122,297

(22) PCT Filed: Jan. 14, 2015

(86) PCT No.: PCT/JP2015/050764
§ 371 (c)(1),
(2) Date: Aug. 29, 2016

(87) PCT Pub. No.: WO2015/141256
PCT Pub. Date: Sep. 24, 2015

(65) Prior Publication Data

US 2016/0368644 A1 Dec. 22, 2016

(30) Foreign Application Priority Data

Mar. 19, 2014 (JP) ..... 2014-055923

(51) Int. Cl.
*B65B 1/22* (2006.01)
*B65B 9/20* (2012.01)
(Continued)

(52) U.S. Cl.
CPC ..... *B65B 59/04* (2013.01); *B65B 1/22* (2013.01); *B65B 9/20* (2013.01); *B65B 9/2028* (2013.01); *B65B 61/00* (2013.01)

(58) Field of Classification Search
CPC ..... B65B 59/04
(Continued)

(56) References Cited

U.S. PATENT DOCUMENTS 4,565,050 A * 1/1986 Norris ..... B65B 7/20 53/376.5

FOREIGN PATENT DOCUMENTS

JP 63-232106 A 9/1988
JP 2005-041576 A 2/2005
(Continued)

OTHER PUBLICATIONS

Translation of the Written Opinion of the International Searching Authority, dated Sep. 20, 2016.

*Primary Examiner* — Lori L Baker
(74) *Attorney, Agent, or Firm* — Global IP Counselors, LLP

(57) ABSTRACT

A bag making and packaging machine is configured with a member that is easily detachable therefrom. The bag making and packaging machine includes a forming mechanism, a transverse sealing mechanism, a shaker unit, and an installation unit. The forming mechanism forms a film into a tubular shape as the film moves in a downward direction. The transverse sealing mechanism is installed below the forming mechanism, seals the film formed in a tubular shape in a direction transverse to the downward direction. The shaker unit acts on the film to improve a state of the film. The shaker unit is detachable. The installation unit is a member for installing the shaker unit below the forming mechanism and above the transverse sealing mechanism. The installation unit places the shaker unit thereon, supports the shaker unit, and has a slide surface for sliding the shaker unit in a horizontal direction.

8 Claims, 15 Drawing Sheets

(51) Int. Cl.
*B65B 59/04* (2006.01)
*B65B 61/00* (2006.01)

(58) Field of Classification Search
USPC ..... 53/525
See application file for complete search history.

(56) References Cited

FOREIGN PATENT DOCUMENTS

| | | | |
|---|---|---|---|
| JP | 2006-500287 | A | 1/2006 |
| JP | 2012-180115 | A | 9/2012 |
| JP | 2013-230842 | A | 11/2013 |
| JP | 2014-005066 | A | 1/2014 |

* cited by examiner

BAG MAKING AND PACKAGING MACHINE

CROSS-REFERENCE TO RELATED APPLICATIONS

This U.S. National stage application of PCT/JP2015/050764 claims priority under 35 U.S.C. § 119(a) to Japanese Patent Application No. 2014-055923, filed in Japan on Mar. 19, 2014, the entire contents of which are hereby incorporated herein by reference.

TECHNICAL FIELD

The present invention relates to a bag making and packaging machine.

BACKGROUND ART

As disclosed in patent literature 1 (JP-A-2005-41576), a conventional bag making and packaging machine has been used to fill articles to be packaged such as food into a bag, seal and package the bag while making the bag. In this bag making and packaging machine, a packaging material, which is a sheet-like film, is formed into a tube shape by a former, and overlapping end parts of the tubular packaging material are longitudinally sealed by a longitudinal sealing mechanism. Next, after the articles to be packaged have been filled into the tubular packaging material, and the packaging material has been transversely sealed by a transverse sealing mechanism, a transversely sealed portion is cut by a cutter. In this bag making and packaging machine, the above operations, i.e., formation of a bag and filling articles to be packaged into a bag are successively repeated.

Moreover, a member for acting on the packaging material to improve a package state is attached to this bag making and packaging machine. As such a member, a shaker unit physically vibrating a tubular packaging material to reduce a pile of articles to be packaged in the tubular packaging material is used, for example. The shaker unit is detachable from a main body of the bag making and packaging machine. In order to replace a shaker unit, an attached shaker unit needs to be completely detached, and a new shaker unit needs to be precisely attached at a predetermined location.

SUMMARY OF INVENTION

Technical Problem

However, a shaker unit is typically a heavy object manufactured of steel, an alloy or the like having high strength and dimensional precision. Moreover, such a shaker unit is typically detached from and attached to a frontal side of the main body of a packaging machine. However, occasionally, there may not be a sufficient space around the main body of the packaging machine allocated for a worker replacing the shaker unit due to a rising conveyor installed to a lower portion of the main body of the packaging machine. In this case, the worker needs to take an uncomfortable posture, for example, to twist his body, to replace the shaker unit. Therefore, with a conventional bag making and packaging machine, the replacement of a shaker unit needs considerable labor.

An object of the present invention is to provide a bag making and packaging machine which enables facilitation of the replacement of a member detachable from a main body.

Solution to Problem

A bag making and packaging machine according to the present invention includes a former, a transverse sealing mechanism, an action part, and an installation part. The former forms a packaging material into a tubular shape. The transverse sealing mechanism is installed below the former. The transverse sealing mechanism seals the packaging material formed into a tubular shape in a transverse direction. The action part acts on the packaging material formed into a tubular shape to improve a state of the packaging material. The action part is detachable. The installation part is a member for installing the action part below the former and above the transverse sealing mechanism. The installation part has a slide surface for placing the action part thereon, supporting the action part, and sliding the action part in a horizontal direction.

This bag making and packaging machine includes the action part detachable from a main body. The action part is a member being able to be detached from and attached to the main body. The action part attached to the main body is supported by the installation part. The action part is slidable in the horizontal direction. Therefore, the action part slides, and thereby the action part is readily able to be detached from and attached to the main body. Consequently, this bag making and packaging machine enables facilitation of the replacement of the member detachable from the main body.

In the bag making and packaging machine according to the present invention, it is preferable that the action part has a wheel rotating while contacting the slide surface when the action part slides in the horizontal direction.

In this bag making and packaging machine, the action part has the wheel, and thereby is readily slidable in the horizontal direction.

In the bag making and packaging machine according to the present invention, it is preferable that the action part has a first state in which the action part is supported only by the installation part or a second state in which the action part is slidable in the horizontal direction and at least a portion thereof is supported by the installation part. In this case, the wheel is not in contact with the slide surface if the action part is in the first state, and is in contact with the slide surface if the action part is in the second state.

In this bag making and packaging machine, the action part in the first state is readily fixable to the installation part because the wheel is not in contact with the slide surface, and the action part in the second state is readily detachable from the installation part because the wheel is in contact with the slide surface.

In the bag making and packaging machine according to the present invention, it is preferable that the action part has the wheel rotating in a direction in which the action part slides when the action part is mounted on the installation part, and the action part has a fastening part attached to a location different from the wheel. The fastening part is able to be fastened to the installation part if the action part is in the first state.

In this bag making and packaging machine, the action part in the first state is able to be securely fixed to the main body because the action part is fastened to the installation part with the fastening part.

In the bag making and packaging machine according to the present invention, it is preferable that the action part is inclined, and thereby is able to be switched from the first state to the second state.

In this bag making and packaging machine, the action part is able to be readily switched between the first state and the second state.

In the bag making and packaging machine according to the present invention, it is preferable that the action part has a connector attached to a side opposite to a direction in which the action part slides when the action part is mounted on the installation part and the connector is connected to a drive actuator of the action part.

In this bag making and packaging machine, the drive actuator of the action part is able to be readily connected to an external circuit and the like.

In the bag making and packaging machine according to the present invention, it is preferable that the action part is a shaker unit vibrating the packaging material in a tubular shape.

In this bag making and packaging machine, the shaker unit as the action part vibrates the tubular packaging material, and thereby is able to reduce a pile of articles to be packaged in the tubular packaging material.

Advantageous Effect of Invention

The bag making and packaging machine according to the present invention enables facilitation of the replacement of the member detachable from the main body.

DESCRIPTION OF EMBODIMENT

The bag making and packaging machine according to an embodiment of the present invention will be described with reference to the drawings. The embodiment described below is merely a specific example of the present invention, and does not limit the technical scope of the present invention.

(1) Configuration of Bag Making and Packaging Machine

Figure 1:
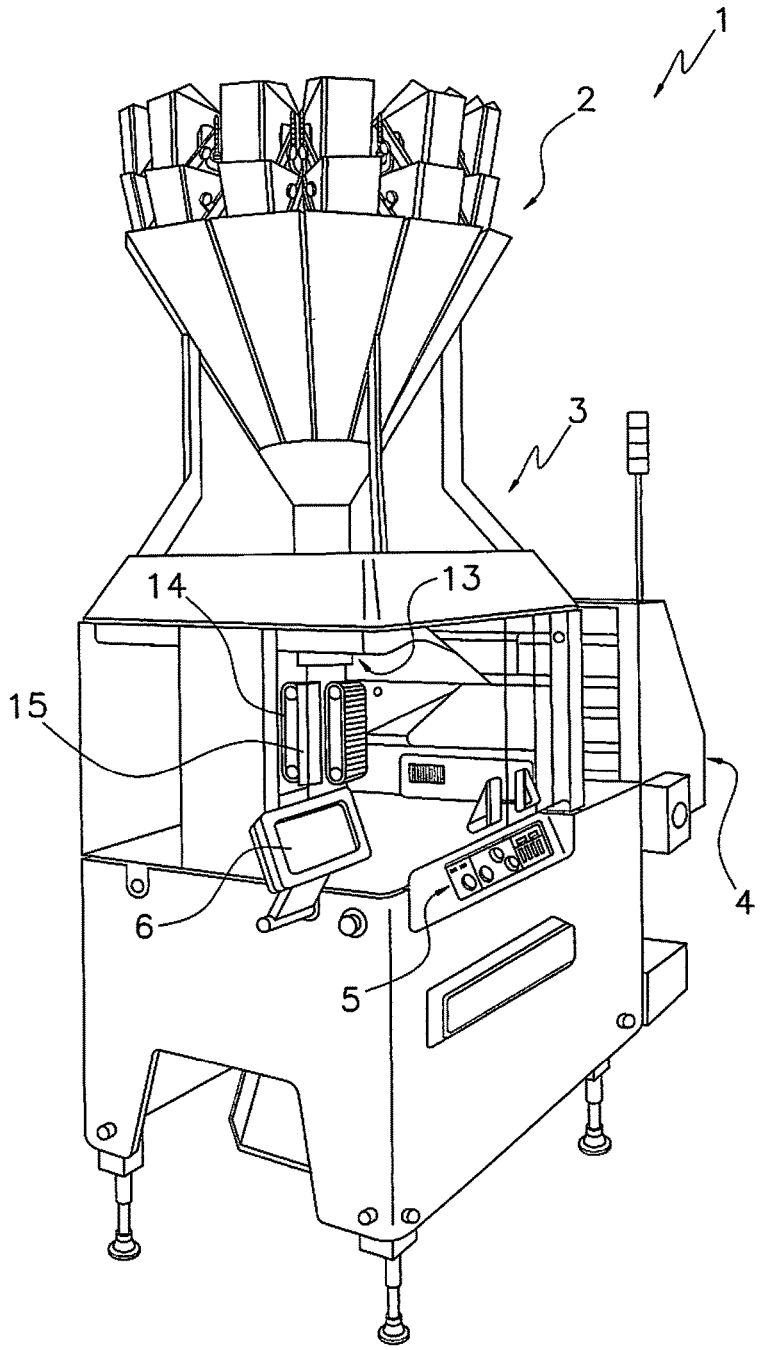
FIG. 1 is a perspective view of a bag making and packaging machine according to the embodiment of the present invention.

FIG. 1 is a perspective view of a bag making and packaging machine 1 according to the embodiment of the present invention. The bag making and packaging machine 1 is a machine for packaging articles to be packaged such as food in a bag. The bag making and packaging machine 1 is primarily configured with a combination weighing unit 2, a bag making and packaging unit 3, and a film supply unit 4.

The combination weighing unit 2 is arranged above the bag making and packaging unit 3. The combination weighing unit 2 weighs articles to be packaged with a plurality of weighing hoppers, and combines values of weights weighed with individual weighing hoppers in such a manner that the sum of the values of weights reaches a predetermined total weight. The combination weighing unit 2 downwardly ejects articles to be packaged having the combined predetermined total weight to supply the bag making and packaging unit 3 with the articles.

The bag making and packaging unit 3 fills the articles to be packaged into a bag, and seals the bag in accordance with the timing at which the articles to be packaged are supplied from the combination weighing unit 2. A detailed configuration and operation of the bag making and packaging unit 3 will be described later.

The film supply unit 4 is installed adjacent to the bag making and packaging unit 3, and supplies the bag making and packaging unit 3 with a film for packaging, which will be formed into a bag. A film roll around which the film is wound is loaded in the film supply unit 4. The film is delivered out from the film roll to the film supply unit 4.

The bag making and packaging machine 1 includes an operational switch 5 and a liquid crystal display 6, which are attached to a front surface of a main body thereof. The liquid crystal display 6 is a touch panel display arranged at a location that is visible to an operator operating the operational switch 5. The operational switch 5 and the liquid crystal display 6 function as input devices for receiving commands to the bag making and packaging machine 1 and settings regarding the bag making and packaging machine 1. The liquid crystal display 6 functions as an output device for displaying information regarding the bag making and packaging machine 1.

The bag making and packaging machine 1 includes a control part (not illustrated) housed in the main body thereof. The control part is a computer configured with a CPU, ROM, RAM and the like. The control part is connected to the combination weighing unit 2, the bag making and packaging unit 3, the film supply unit 4, the operational switch 5, and the liquid crystal display 6. The control part controls the combination weighing unit 2, the bag making and packaging unit 3, and the film supply unit 4 on the basis of input from the operational switch 5 and the liquid crystal display 6, and outputs various information to the liquid crystal display 6. The control part obtains information from various sensors attached to the combination weighing unit 2, the bag making and packaging unit 3, and the film supply unit 4 to use the information for control of each of units.

(2) Configuration of Bag Making and Packaging Unit

Figure 2:
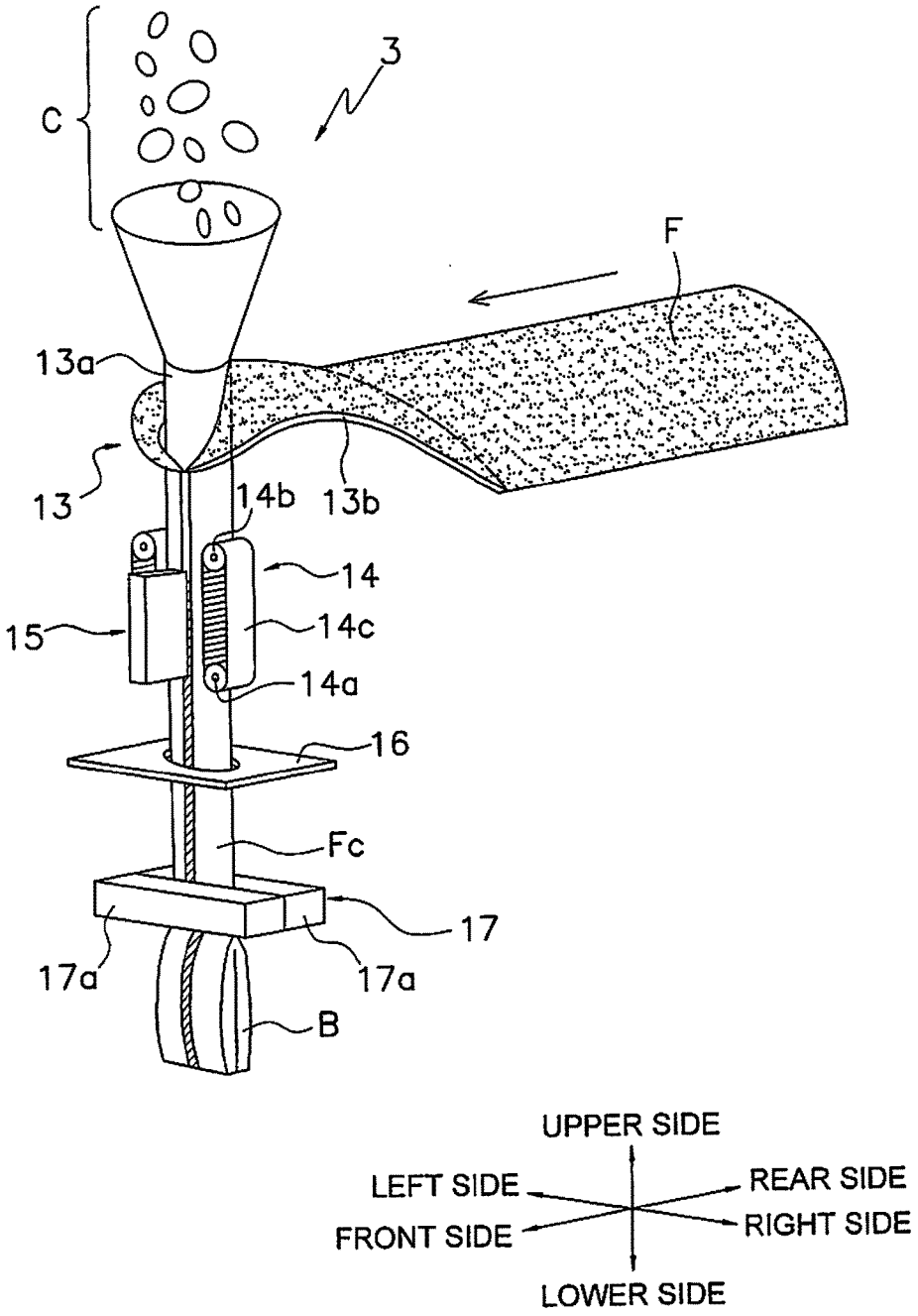
FIG. 2 is a perspective view illustrating a schematic configuration of a bag making and packaging unit.

FIG. 2 is a perspective view illustrating a schematic configuration of the bag making and packaging unit 3. In the description below, six directions of "front side (frontal side)," "rear side (back side)," "upper side," "lower side," "left side," and "right side" are defined as in FIG. 2.

The bag making and packaging unit 3 is primarily configured with a forming mechanism 13, a pull-down belt mechanism 14, a longitudinal sealing mechanism 15, a shaker unit 16 (also referred to as an action part), and a transverse sealing mechanism 17. The forming mechanism 13 forms a sheet-shaped film F conveyed from the film supply unit 4 into a tubular shape. The pull-down belt mechanism 14 downwardly conveys the film F formed in a tubular shape. The longitudinal sealing mechanism 15 seals an overlap of both end parts of the film F formed in a tubular shape in a longitudinal direction parallel to the conveyance direction to make a tubular film Fc. The shaker unit 16 (the action part) vibrates the tubular film Fc. The transverse sealing mechanism 17 seals the tubular film Fc in the transverse direction orthogonal to the conveyance direction to make a bag B having transversely sealed upper and lower end portions. Next, each of components of the bag making and packaging unit 3 will be described.

(2-1) Forming Mechanism

The forming mechanism 13 has a tube 13*a* and a sailor-collar-shaped part 13*b*. The tube 13*a* is a cylindrical shaped member having openings in upper and lower ends thereof. Articles C to be packaged, which are supplied from the combination weighing unit 2, are dropped into the opening in the upper end of the tube 13*a*. The sailor-collar-shaped part 13*b* is arranged so as to surround the tube 13*a*. The film F delivered out from the film roll of the film supply unit 4 is wound around the tube 13*a*, and is formed into a tubular shape when passing a clearance between the tube 13*a* and the sailor-collar-shaped part 13*b*. The tube 13*a* and the sailor-collar-shaped part 13*b* are able to be replaced in accordance with the size of the bag B to be manufactured.

(2-2) Pull-Down Belt Mechanism

The pull-down belt mechanism 14 sticks the film F wound around the tube 13*a* and conveys the film downwardly. The pull-down belt mechanism 14 primarily has drive rollers 14*a*, driven rollers 14*b* and a pair of belts 14*c*. As illustrated in FIG. 2, the pair of belts 14*c* are arranged on the left and right sides of the tube 13*a* so as to sandwich the tube 13*a*, and have a mechanism that sticks the film F formed in a tubular shape. The pair of belts 14*c* are rotatably driven by the drive rollers 14*a* and the driven rollers 14*b*, and thereby the pull-down belt mechanism 14 downwardly conveys the film F formed in a tubular shape.

(2-3) Longitudinal Sealing Mechanism

The longitudinal sealing mechanism 15 seals the film F formed in a tubular shape in the longitudinal direction (in the up-down direction in FIG. 2). The longitudinal sealing mechanism 15 is arranged on the frontal side of the tube 13*a*. The longitudinal sealing mechanism 15 moves in the front-rear direction by a drive mechanism (not illustrated) so as to move toward or move away from the tube 13*a*.

The longitudinal sealing mechanism 15 is driven by the drive mechanism so as to move toward the tube 13*a*, and thereby the overlap of the film F in the longitudinal direction wound around the tube 13*a* is sandwiched between the longitudinal sealing mechanism 15 and the tube 13*a*. The longitudinal sealing mechanism 15 heats the overlap of the film F while pressing the overlap of the film F against the tube 13*a* by a given pressure by the drive mechanism, seals the overlap of the film F in the longitudinal direction, and makes a tubular film Fc. The longitudinal sealing mechanism 15 has a heater heating the overlap of the film F, a heater belt that contacts the overlap of the film F and the like.

(2-4) Shaker Unit

The shaker unit 16 vibrates the tubular film Fc to impart vibration to the articles C to be packaged piled in the tubular film Fc, and thereby reduces a pile of the articles C to be packaged. That is, the shaker unit 16 is a mechanism that acts on the tubular film Fc to improve a state of the tubular film Fc. The shaker unit 16 is arranged below the forming mechanism 13, the pull-down belt mechanism 14, and the longitudinal sealing mechanism 15 as well as above the transverse sealing mechanism 17. The shaker unit 16 is detachable from the bag making and packaging machine 1. That is, the shaker unit 16 is an independent unit that is able to be detached from and attached to the bag making and packaging unit 3. A detailed configuration of the shaker unit 16 will be described later.

(2-5) Transverse Sealing Mechanism

The transverse sealing mechanism 17 seals the tubular film Fc in the transverse direction (in the left-right direction in FIG. 2). The transverse sealing mechanism 17 is arranged below the forming mechanism 13, the pull-down belt mechanism 14, the longitudinal sealing mechanism 15, and the shaker unit 16. The transverse sealing mechanism 17 includes a pair of sealing jaws 17*a*. The transverse sealing mechanism 17 includes a motor (not illustrated) that revolves the sealing jaws 17*a* in such a manner that the pair of sealing jaws 17*a* move symmetrically to each other in a D-shaped trajectory on opposite sides of the tubular film Fc. The pair of sealing jaws 17*a* move toward and away from each other in the front-rear direction.

The transverse sealing mechanism 17 sandwiches the tubular film Fc between the pair of sealing jaws 17*a*, heats the tubular film Fc using heaters housed in the sealing jaws 17*a* to seal the tubular film Fc in the transverse direction. The transverse sealing mechanism 17 seals the upper and lower end portions of the tubular film Fc in the transverse direction to make the bag B. Next, the transverse sealing mechanism 17 uses a cutter housed in one of the sealing jaws 17*a* to cut and separate the bag B from the subsequent tubular film Fc at the center position of a transversely sealed portion of the film Fc in the height direction (in the up-down direction in FIG. 2).

(3) Configuration of Shaker Unit

Figure 3:
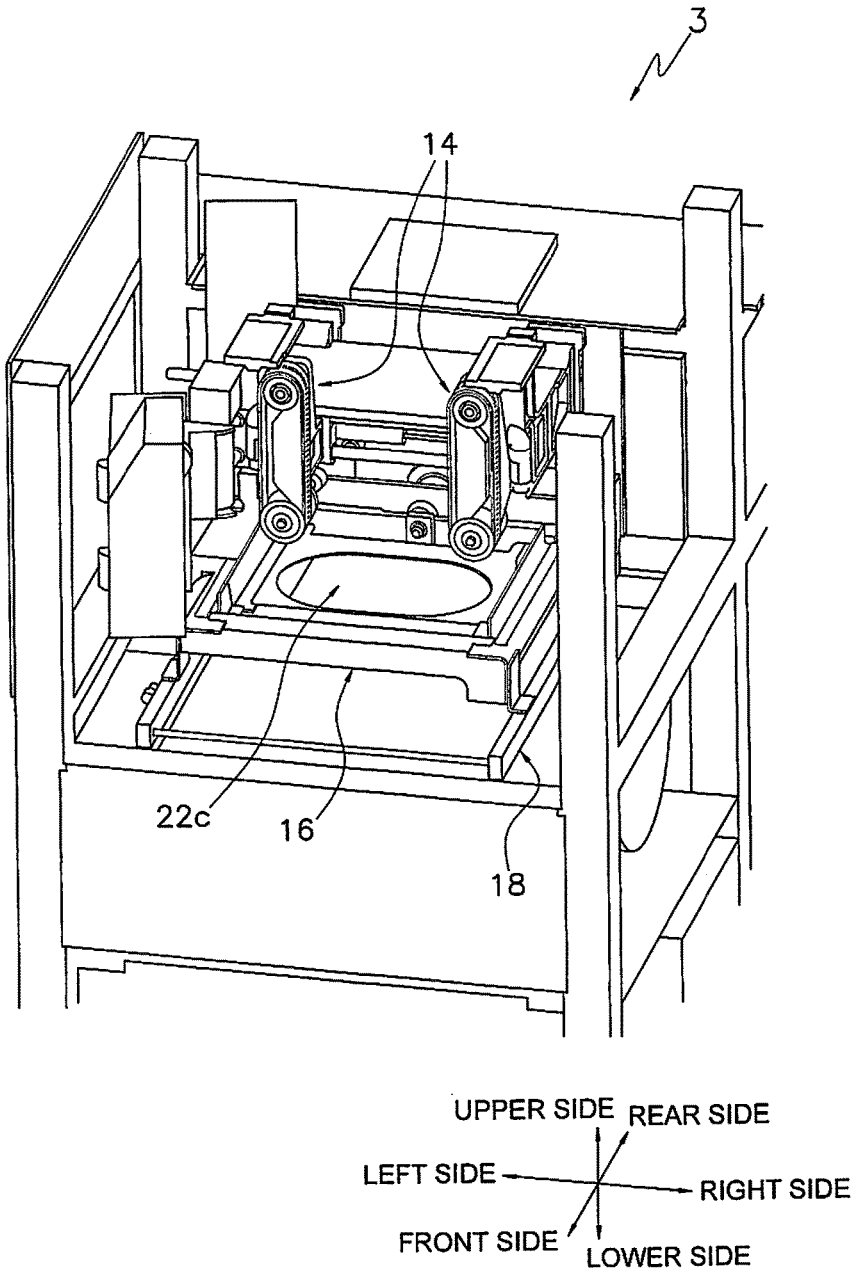
FIG. 3 is a perspective view of the bag making and packaging unit.

Next, the detailed configuration of the shaker unit 16 will be described. FIG. 3 is a perspective view of the bag making and packaging unit 3 to which the shaker unit 16 is attached. As illustrated in FIG. 3, the shaker unit 16 attached to the bag making and packaging unit 3 is placed on an installation unit 18 fixed to the bag making and packaging unit 3. The shaker unit 16 is installed below the pull-down belt mechanism 14. The shaker unit 16 is an independent unit that is able to be attached to and detached from the bag making and packaging unit 3 from the front side (the frontal side) of the bag making and packaging unit 3.

Figure 4:
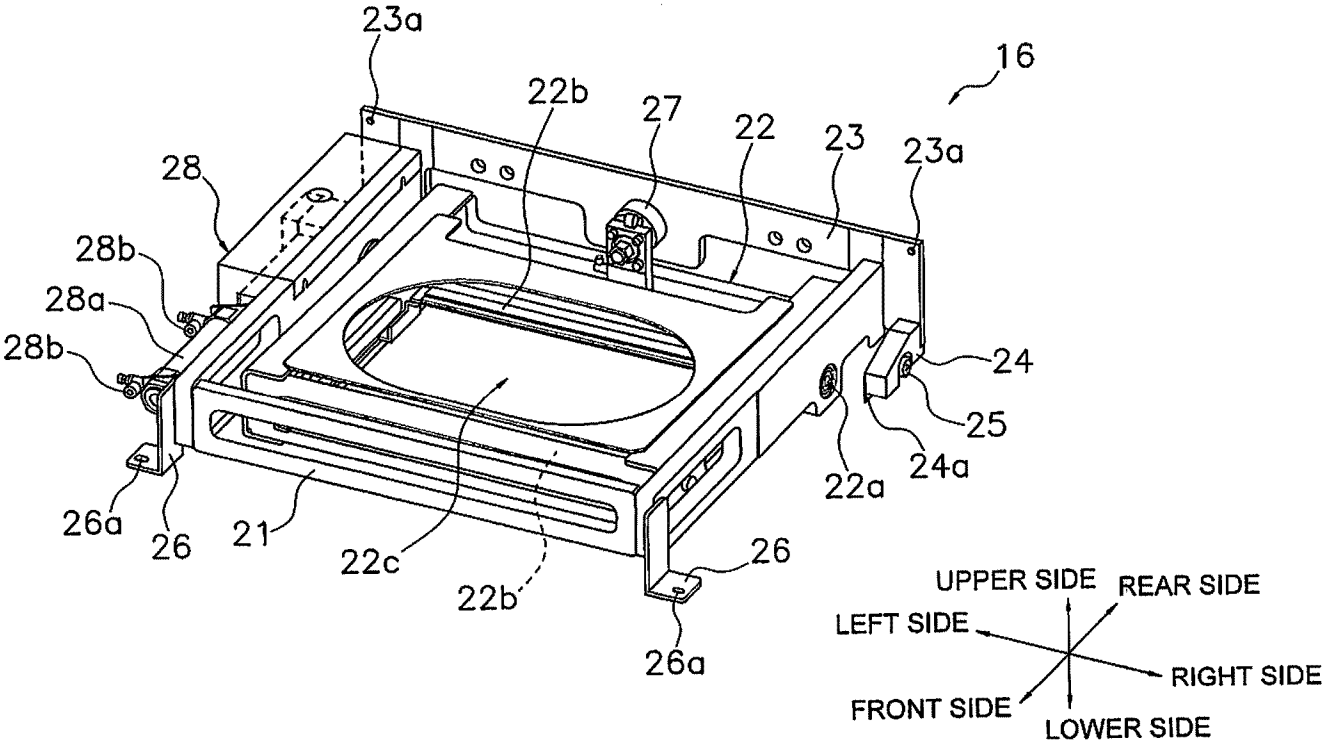
FIG. 4 is a perspective view of a shaker unit.

FIG. 4 is a perspective view of the shaker unit 16. The shaker unit 16 is primarily configured with a frame 21, a vibration part 22, a backplate 23, a pair of wheel stops 24, a pair of wheels 25, a pair of fastening parts 26, a coupling part 27, and a drive actuator 28.

The frame 21 is a member corresponding to a main body of the shaker unit 16. Other components of the shaker unit 16 are attached to the frame 21.

The vibration part 22 is a member surrounded by the frame 21. As illustrated in FIG. 4, the vibration part 22 is attached to the frame 21 via a rotational shaft 22*a* extending in the left-right direction. The rotational shaft 22*a* is fixedly attached to the rear side of the vibration part 22, and is rotatably attached to the rear side of the frame 21. The vibration part 22 rotates about the rotational shaft 22*a* in a predetermined angular range so that a front-side end portion thereof vibrates in the up-down direction. Moreover, as illustrated in FIGS. 3 and 4, the vibration part 22 has a pair of film vibration plates 22*b*, and a film passage hole 22*c*. The pair of film vibration plates 22*b* are installed so as to face each other in the front-rear direction. The pair of film vibration plates 22*b* move toward and away from each other in the front-rear direction by the drive actuator 28. The film passage hole 22*c* is a hole through which the tubular film Fc, which is conveyed downwardly from above by the pull-down belt mechanism 14, passes. In a state in which the tubular film Fc is passing through the film passage hole 22*c*, and when the pair of film vibration plates 22*b* move toward each other, the tubular film Fc is sandwiched by the pair of film vibration plates 22*b*. In a state in which the tubular film Fc is sandwiched by the pair of film vibration plates 22*b*, and when the vibration part 22 rotates about the rotational shaft 22*a*, the tubular film Fc vibrates upwardly and downwardly.

The backplate 23 is a member attached to the rear side of the frame 21. The backplate 23 is a plate extending in the left-right direction. The backplate 23 has a pair of through holes 23*a*. The pair of through holes 23*a* are made at both left-side and right-side upper portions of the backplate 23.

The pair of wheel stops 24 are members that are each attached to left-side and right-side end portions of the backplate 23. The pair of wheel stops 24 are attached at the lower-side end portion of the backplate 23. In FIG. 4, only the right-side wheel stop 24 is illustrated. Moreover, a guide plate 24*a* is attached to each of the wheel stops 24. Each guide plate 24*a* is attached to a left-side side surface of the right-side wheel stop 24 and a right-side side surface of the left-side wheel stop 24.

The pair of wheels 25 are members supported by the pair of wheel stops 24. The wheel 25 has a rotational shaft in the left-right direction, and is a roller that is able to rotate in the front-rear direction as described later. In FIG. 4, only the right-side wheel 25 is illustrated.

The pair of fastening parts 26 are attached to both left and right sides of the frame 21 at the front side of the frame 21. The fastening part 26 is a plate having an L-shape. The fastening part 26 has one through hole 26*a*. As illustrated in FIG. 4, the through hole 26*a* is made in a portion parallel to a horizontal surface of the fastening part 26.

The coupling part 27 is a member attached to the backplate 23 and coupled to the central portion of the rear-side end portion of the vibration part 22. The coupling part 27 is a mechanism for transmitting to the vibration part 22 a force rotating the vibration part 22 about the rotational shaft 22*a*. A generation source of the force rotating the vibration part 22 is a later-described drive part 34 of the installation unit 18.

The drive actuator 28 is a mechanism for allowing the pair of film vibration plates 22*b* to move toward and away from each other in the front-rear direction to close and open the pair of film vibration plates 22*b*. The drive actuator 28 has an air cylinder 28*a*. The drive actuator 28 converts the operations of the air cylinder 28*a* to the operations of opening and closing the pair of film vibration plates 22*b*. The air cylinder 28*a* has connectors 28*b*. The connectors 28*b* are connected to a later-described fitting 35 of the installation unit 18 with air pipes.

(4) Configuration of Installation Unit

Figure 5:
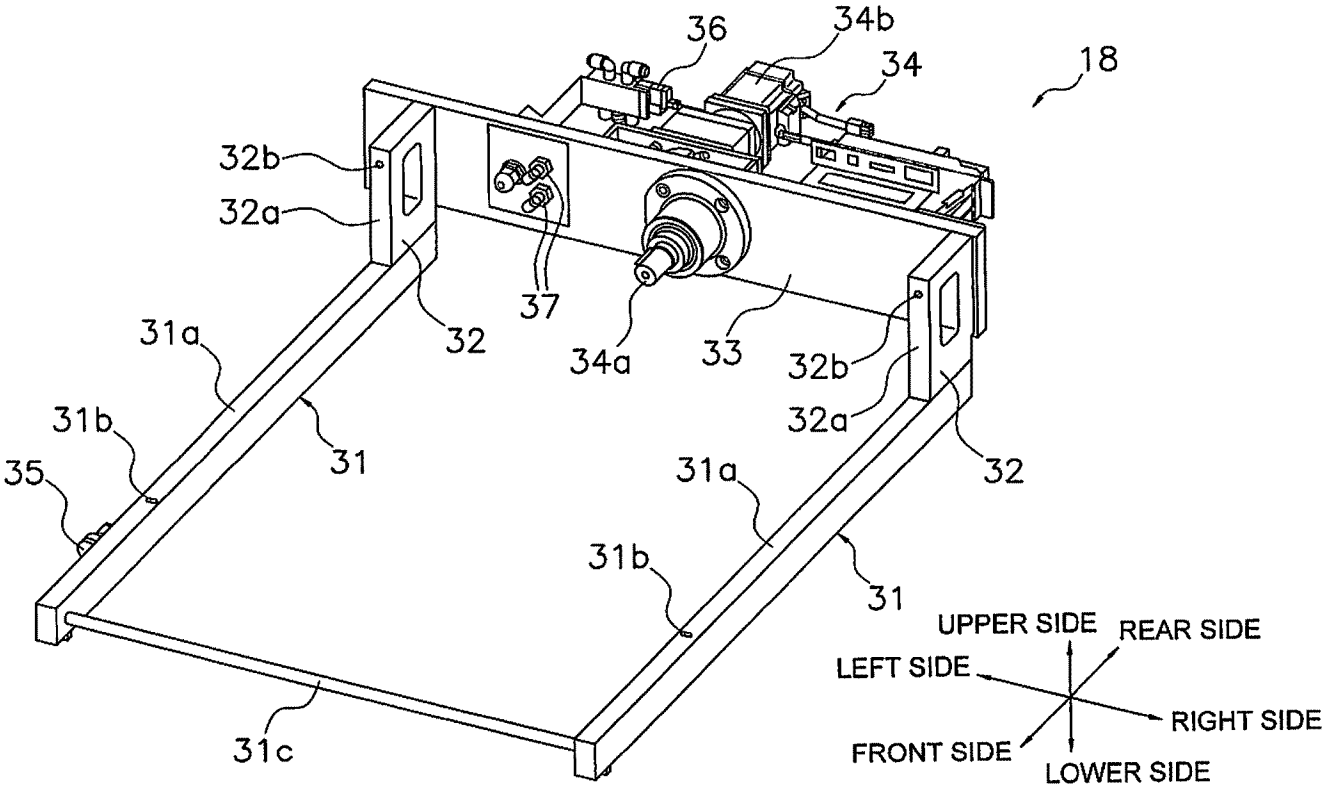
FIG. 5 is a perspective view of an installation unit.

As illustrated in FIG. 3, the installation unit 18 is a unit for supporting the shaker unit 16. The installation unit 18 is fixed to the bag making and packaging unit 3. FIG. 5 is a perspective view of the installation unit 18. The installation unit 18 is primarily configured with a pair of guides 31, a pair of fixation plates 32, a support plate 33, the drive part 34, the fitting 35, a solenoid valve 36, and pipe connectors 37.

The pair of guides 31 are rod-shaped members extending in the front-rear direction at both left and right sides of the installation unit 18. The guide 31 has a slide surface 31*a*. The slide surface 31*a* is an upper surface of the guide 31, and is a horizontal surface on which the shaker unit 16 is placed. Upon the attachment and detachment of the shaker unit 16, each of the pair of wheels 25 of the shaker unit 16 is placed on each of the pair of slide surfaces 31*a*. The guide 31 has a bolt hole 31*b*. The bolt hole 31*b* is made at the front side of the slide surface 31*a*. Moreover, as illustrated in FIG. 5, the front-side end portions of the pair of guides 31 are coupled to each other with a support part 31*c* extending in the left-right direction.

Each of the pair of fixation plates 32 is a member attached to the rear side of each of the pair of guides 31. The fixation plate 32 is fixed to the slide surface 31*a*. The fixation plate 32 has a contact surface 32*a* facing forward. The fixation plate 32 has a bolt hole 32*b*. The bolt hole 32*b* is made at the upper side of the contact surface 32*a*.

The support plate 33 is a member attached to rear-side surfaces of the pair of fixation plates 32. The support plate 33 couples the pair of fixation plates 32 to each other. The support plate 33 is a plate fixed to the bag making and packaging unit 3.

The drive part 34 is attached to the support plate 33. The drive part 34 has a rotational shaft 34*a* and a motor 34*b*. The rotational shaft 34*a* protrudes forward from the support plate 33. When the shaker unit 16 is attached to the installation unit 18, the rotational shaft 34*a* is coupled to the coupling part 27 of the shaker unit 16. The motor 34*b* is a power source of the drive part 34. The drive part 34 rotates the rotational shaft 34*a* with the motor 34*b* to transmit a force to the vibration part 22 of the shaker unit 16 via the coupling part 27. That is, the drive part 34 is a generation source of a force rotating the vibration part 22.

The fitting 35 is a quick-connect fitting attached to a front-side side surface of one guide 31. The fitting 35 is connected to the connectors 28*b* of the drive actuator 28 of the shaker unit 16 and the pipe connectors 37 with air pipes.

The solenoid valve 36 is a solenoid valve for controlling the opening and closing of the pair of film vibration plates 22*b* of the shaker unit 16. The solenoid valve 36 is connected to the pipe connectors 37 with air pipes.

The pipe connectors 37 are connected to the fitting 35 and the solenoid valve 36 with air pipes.

(5) Method of Attaching and Detaching Shaker Unit

Figure 6:
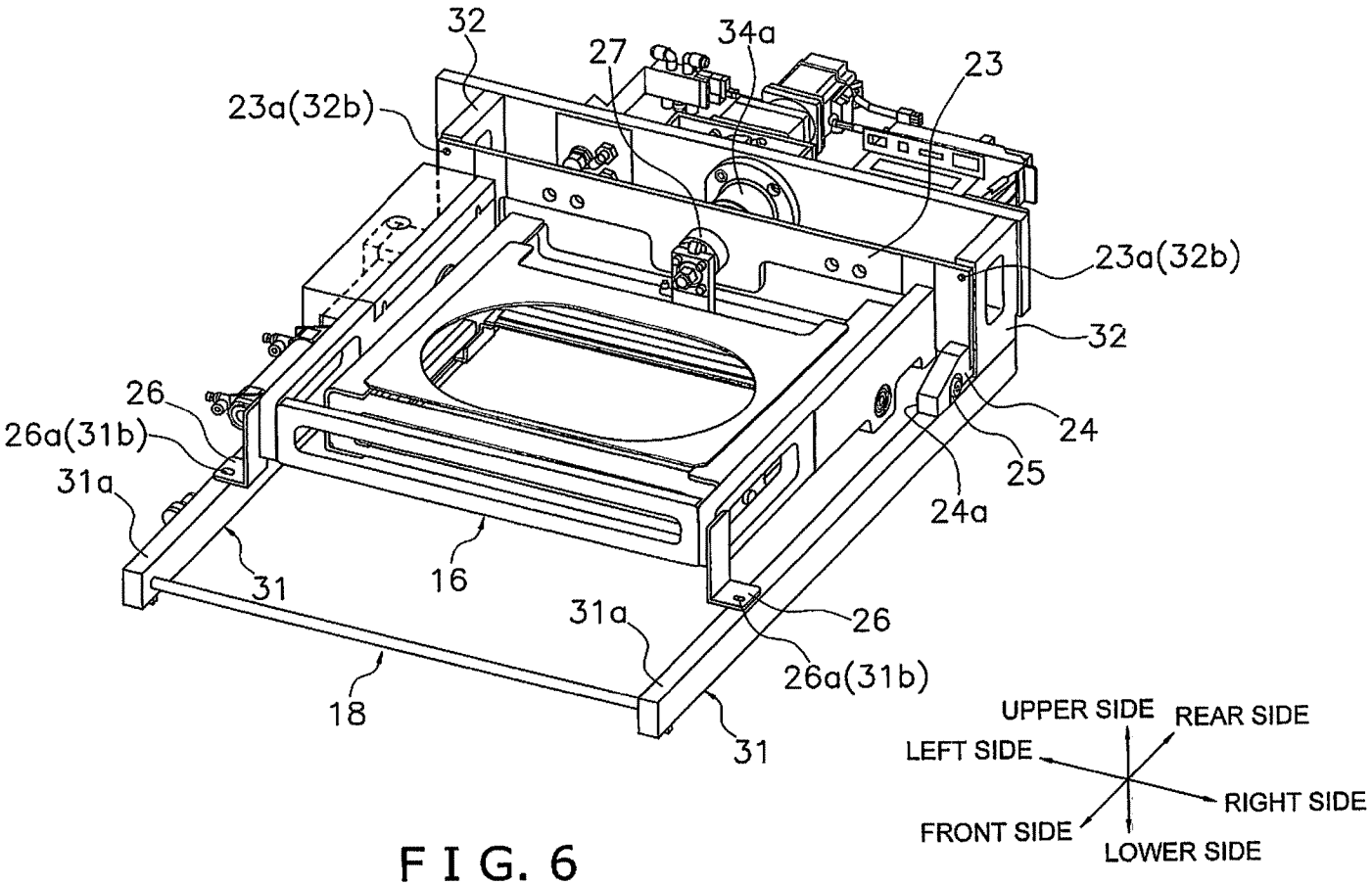
FIG. 6 is a perspective view of the shaker unit supported by the installation unit.

Next, the operations of a worker to attach the shaker unit 16 (the action part) to the bag making and packaging unit 3 and to detach the shaker unit 16 from the bag making and packaging unit 3 will be described. The worker is able to perform these operations at the front side of the bag making and packaging machine 1. FIG. 6 is a perspective view of the shaker unit 16 supported by the installation unit 18. The shaker unit 16 is movable between an installed orientation (also referred to as a support state) and an installation orientation (also referred to as a movable state). In the installed orientation, the shaker unit 16 can operate as designed within the bag making and packaging unit 3. In the installation orientation, the shaker unit 16 is easily moved into and out of the bag making and packaging unit 3. In the support state, the shaker unit 16 is supported only by the installation unit 18 and is ready for bag making and back shaking operations. In the movable state, the shaker unit 16 is slidable in the front-rear directions and is supported by the installation unit 18 only via the pair of wheels 25. In other words, in the movable state, the shaker unit 16, being held by the worker, is inclined relative to the installation unit 18 and is supported only by the pair of wheels 25 as the pair of wheels 25 are in rolling contact with the installation unit 18.

(5-1) Method of Attaching Shaker Unit

The operation of the worker to attach the shaker unit 16 to the bag making and packaging unit 3 will be described. The shaker unit 16 will be in a state in which the shaker unit 16 is separated from the bag making and packaging machine 1 and will be able to be carried.

Firstly, the worker lifts the shaker unit 16, and places each of the pair of wheels 25 of the shaker unit 16 on each front side of the slide surface 31*a* of the guide 31 of the installation unit 18. At this time, the worker adjusts a location of the shaker unit 16 in the left-right direction in such a manner that the pair of guide plates 24*a* of the shaker unit 16 are located between the pair of guides 31. This adjustment of the location makes slight clearances between the right-side guide plate 24*a* and the left-side side surface of the right-side guide 31 as well as between the left-side guide plate 24*a* and the right-side side surface of the left-side guide 31. Thereby, the pair of guide plates 24*a* prevents the pair of wheels 25 from being detached from the installation unit 18. From this time, the shaker unit 16 is supported by the guides 31 of the installation unit 18.

Figure 7:
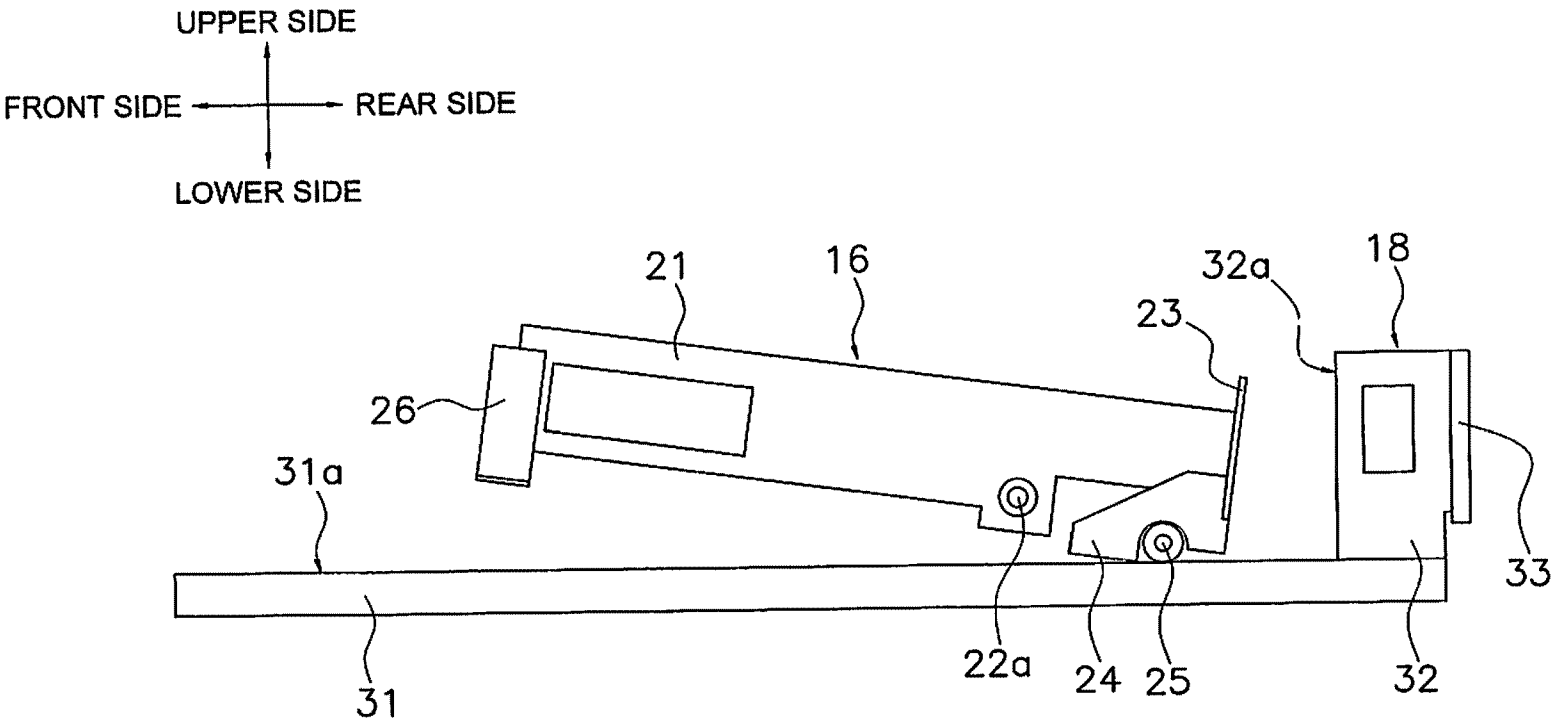
FIG. 7 is a schematic right side view of the shaker unit in a movable state.
Figure 8:
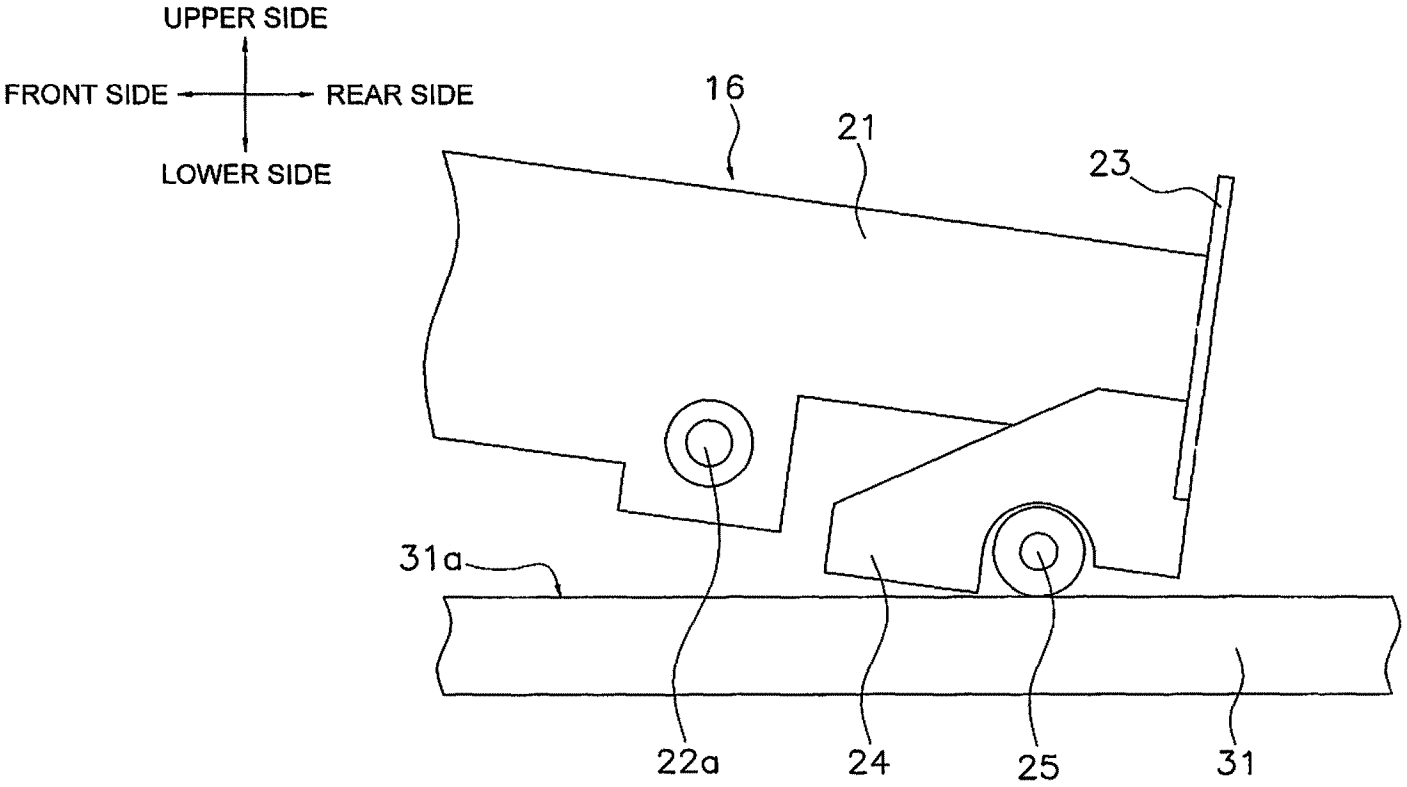
FIG. 8 is an enlarged view of the vicinity of a wheel in FIG. 7.

Next, the worker holds the shaker unit 16 and adjusts an angle of inclination of the shaker unit 16 so that the shaker unit 16 is in the movable state. Specifically, the worker slightly lifts the front side of the shaker unit 16 relative to the rear side of the shaker unit 16. FIG. 7 is a schematic right side view of the shaker unit 16 in this state. FIG. 8 is an enlarged view of the vicinity of the wheel 25 in FIG. 7. As illustrated in FIG. 8, the wheels 25 are in contact with the slide surface 31*a*, and the wheel stops 24 are not in contact with the slide surface 31*a* (only one wheel 25 and one wheel stop 24 is visible in FIG. 8). Therefore, when the worker applies a force in the front-rear direction to the shaker unit 16 in the movable state, the wheels 25 are able to rotate in the front-rear direction on the slide surface 31*a* while contacting the slide surface 31*a*. Therefore, the worker is able to readily move the shaker unit 16 in the movable state in the front-rear direction.

Next, the worker pushes the shaker unit 16 to the rear side until the backplate 23 of the shaker unit 16 is about to hit the contact surface 32*a* of the fixation plate 32 of the installation unit 18.

Figure 9:
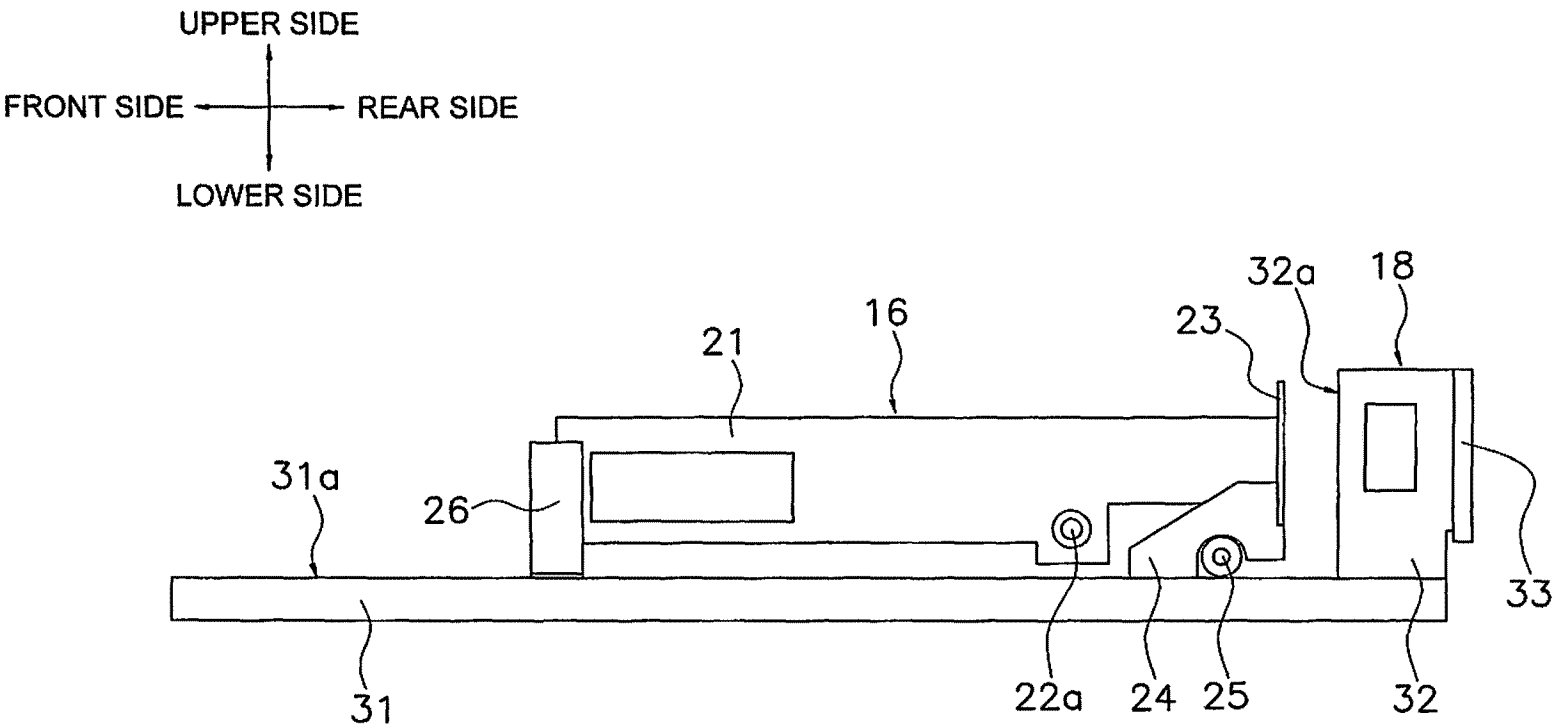
FIG. 9 is a schematic right side view of the shaker unit in a support state.
Figure 10:
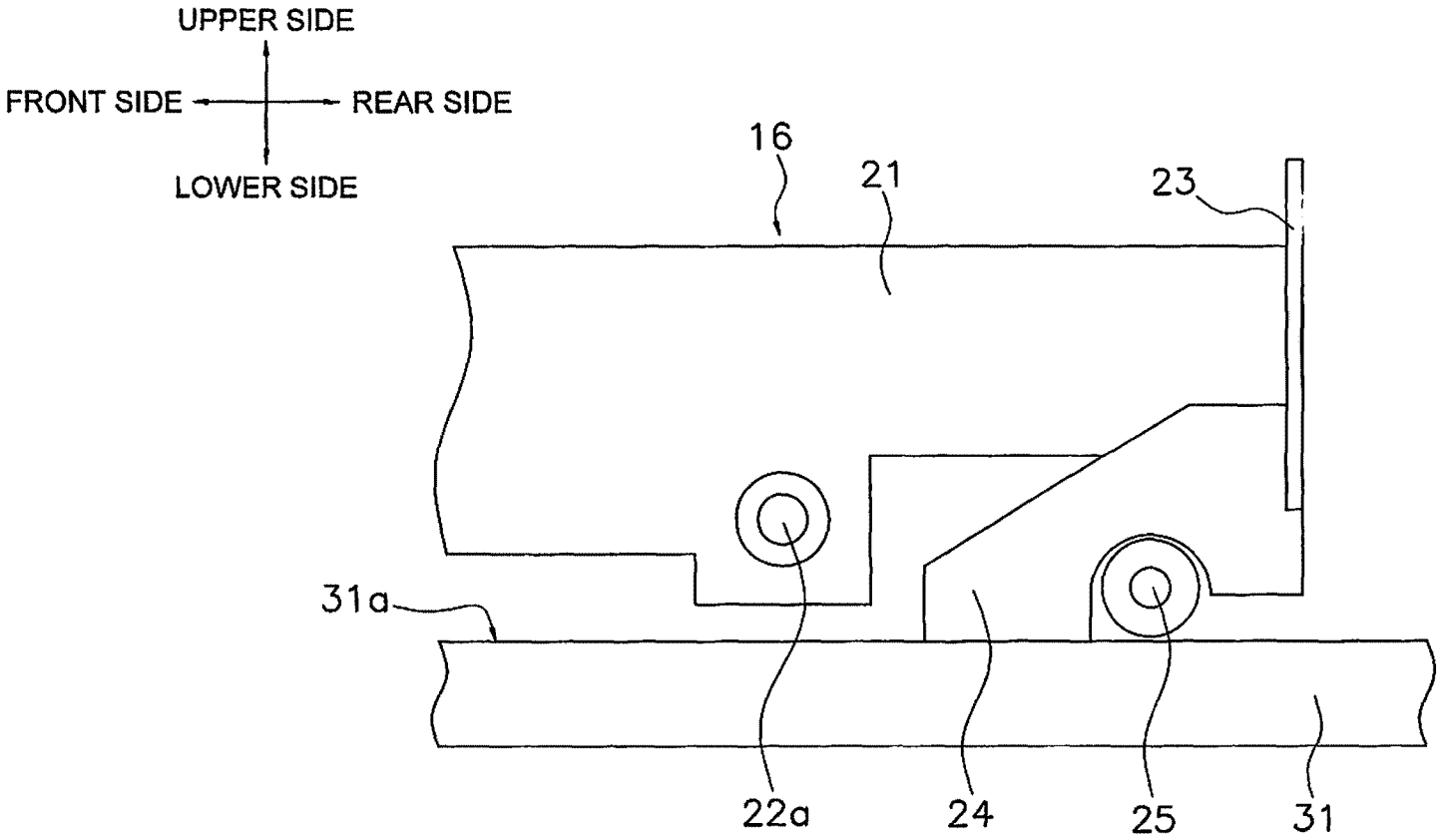
FIG. 10 is an enlarged view of the vicinity of the wheel in FIG. 9.

Next, the worker re-positions the shaker unit 16 so that the shaker unit 16 is in the support state. Specifically, the worker, who have lifted and holds the front side of the shaker unit 16, positions and releases the front side of the shaker unit 16, and makes the pair of fastening parts 26 of the shaker unit 16 move into a state in which the shaker unit 16 is placed on the slide surface 31*a*. FIG. 9 is a schematic right side view of the shaker unit 16 in this support state (installed orientation). FIG. 10 is an enlarged view of the vicinity of the wheel 25 in FIG. 9. As illustrated in FIG. 10, the wheel 25 is not in contact with the slide surface 31*a*, and a front-side bottom surface of the wheel stop 24 is in contact with the slide surface 31*a*. The fastening part 26 is in contact with the slide surface 31*a*. Moreover, at this time, a rear-side surface of the backplate 23 of the shaker unit 16 is not in contact with the contact surface 32*a* of the fixation plate 32 of the installation unit 18.

Figure 11:
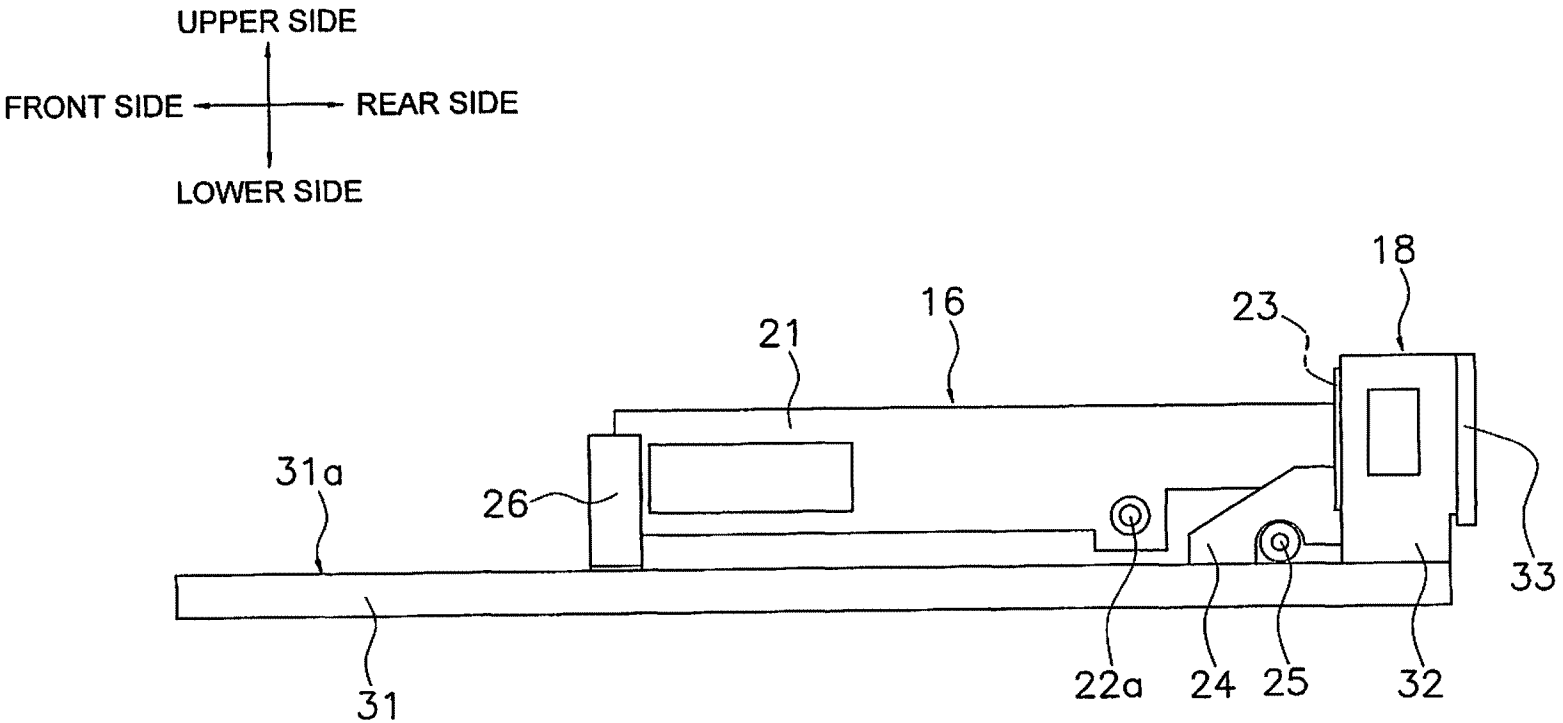
FIG. 11 is a schematic right side view of the shaker unit in the support state.
Figure 12:
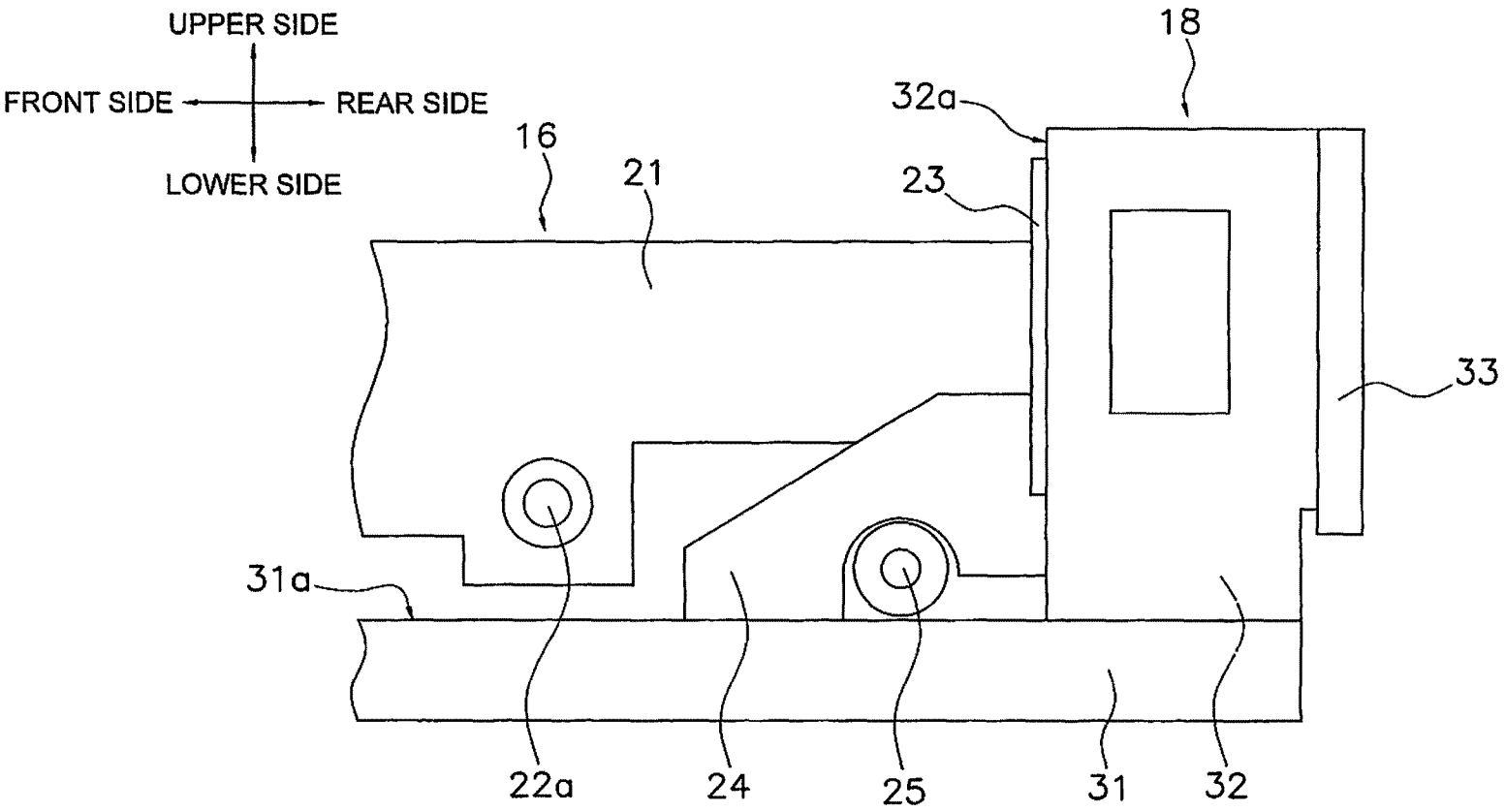
FIG. 12 is an enlarged view of the vicinity of the wheel in FIG. 11.

Next, the worker pushes the shaker unit 16 to the rear side until the coupling part 27 of the shaker unit 16 is fit onto the rotational shaft 34*a* of the drive part 34 of the installation unit 18. Thereby, the rear-side surface of the backplate 23 of the shaker unit 16 contacts the contact surface 32*a* of the fixation plate 32 of the installation unit 18. FIG. 11 is a schematic right side view of the shaker unit 16 in this state. FIG. 12 is an enlarged view of the vicinity of the wheel 25 in FIG. 11. In this state, the through hole 26*a* of the fastening part 26 of the shaker unit 16 is at the same location as that of the bolt hole 31*b* of the guide 31 of the installation unit 18. The through hole 23*a* of the backplate 23 of the shaker unit 16 is at the same location as that of the bolt hole 32*b* of the fixation plate 32 of the installation unit 18.

Next, the worker attaches the shaker unit 16 to the installation unit 18. Specifically, the worker fastens the shaker unit 16 with bolts through four holes in total of the bolt holes 31*b* of the pair of guides 31 and the bolt holes 32*b* of the pair of fixation plates 32 to fix the shaker unit 16 to the installation unit 18. Thereby, the shaker unit 16 and the installation unit 18 becomes in the state as illustrated in FIG. 6.

Next, the worker connects the connectors 28*b* of the drive actuator 28 of the shaker unit 16 to the fitting 35 of the installation unit 18 with air pipes. By a series of the above activities, the worker is able to attach the shaker unit 16 to the bag making and packaging unit 3.

(5-2) Method of Detaching Shaker Unit

The operation of the worker to detach the shaker unit 16 from the bag making and packaging unit 3 will be described. The shaker unit 16, as illustrated in FIG. 11, will be fixed to the bag making and packaging unit 3.

Firstly, the worker detaches the air pipes connecting the connectors 28*b* of the drive actuator 28 of the shaker unit 16 and the fitting 35 of the installation unit 18.

Next, the worker detaches the bolts fastened through the four holes in total of the bolt holes 31*b* of the pair of guides 31 and the bolt holes 32*b* of the pair of fixation plates 32.

Next, as illustrated in FIG. 9, the worker draws the shaker unit 16 to the front side until the coupling part 27 of the shaker unit 16 is detached form the rotational shaft 34*a* of the drive part 34 of the installation unit 18.

Next, as illustrated in FIG. 7, the worker slightly lifts the front side of the shaker unit 16 relative to the rear side of the shaker unit 16. Thereby, the shaker unit 16 becomes in the movable state.

Next, the worker draws the shaker unit 16 to the front side in the state in which the front side of the shaker unit 16 is slightly lifted. While the worker is drawing the shaker unit 16, the wheel 25 of the shaker unit 16 rotates on the slide surface 31*a* while contacting the slide surface 31*a*. The worker draws the shaker unit 16 until the wheel 25 of the shaker unit 16 reaches the front side of the slide surface 31*a* of the installation unit 18.

Next, the worker lifts the shaker unit 16 to separate the shaker unit 16 from the bag making and packaging machine 1. By a series of the above activities, the worker is able to be detached the shaker unit 16 from the bag making and packaging unit 3.

(6) Operation of Bag Making and Packaging Machine

The operation of the bag making and packaging machine 1 to fill the articles C to be packaged into the bag B will be described. Firstly, the film F supplied from the film supply unit 4 to the forming mechanism 13 is wound around the tube 13*a*, is formed into a tubular shape, and is downwardly conveyed by the pull-down belt mechanism 14. Both of the end parts of the film F wound around the tube 13*a*, which extend in the up-down direction, overlap. The overlap of the film F formed into a tubular shape is sealed in the longitudinal direction by the longitudinal sealing mechanism 15, and thereby the tubular film Fc is made.

Next, the longitudinally sealed tubular film Fc travels out of the tube 13*a*, is conveyed to the shaker unit 16, and passes through the shaker unit 16. The tubular film Fc that has passed through the shaker unit 16 is conveyed to the transverse sealing mechanism 17. Simultaneously with the conveyance of the tubular film Fc, the articles C to be packaged weighed by the combination weighing unit 2 are dropped into an opening at the upper end of the tube 13*a*. The articles C to be packaged fall through the tube 13*a*, and are ejected from an opening at the lower end of the tube 13*a*.

At this time, the tubular film Fc has a portion already transversely sealed by the pair of sealing jaws 17*a* of the transverse sealing mechanism 17 below the tube 13*a*. The tubular film Fc above this transversely sealed portion makes the bag B, and only a lower end portion of the bag B is sealed. The articles C to be packaged are dropped into this bag B.

Here, when the articles C to be packaged are dropped into the preceding bag B, the articles C to be packaged can be piled in the tubular film Fc. The shaker unit 16 vibrates the tubular film Fc to impart vibration to the articles C to be packaged piled in the tubular film Fc, and thereby reduces a pile of the articles C to be packaged. Thereby, when the transverse sealing mechanism 17 transversely seals the tubular film Fc, the articles C to be packaged are not sandwiched together with the tubular film Fc by the pair of sealing jaws 17*a*, and thus a transverse sealing defect is able to be prevented.

Next, the pair of sealing jaws 17*a* of the transverse sealing mechanism 17 transversely seals a portion corresponding to an upper end portion of the bag B to make the bag B filled with the articles C to be packaged. At this time, the bag B is connected to the subsequent tubular film Fc. The bag B filled with the articles C to be packaged is cut and separated from the subsequent tubular film Fc by the cutter housed in one of the sealing jaws 17*a*.

The bags B filled with the articles C to be packaged are successively manufactured as described above. The manufactured bags B then are guided by a conveyor belt (not illustrated), and are transported to a thickness checker, a weight checker and the like in following process steps.

(7) Features of Bag Making and Packaging Machine

The bag making and packaging machine 1 according to the present embodiment includes the shaker unit 16 detachable from the bag making and packaging unit 3. The worker is able to attach the shaker unit 16 to the bag making and packaging unit 3 and detach the shaker unit 16 from the bag making and packaging unit 3. The shaker unit 16 attached to the bag making and packaging unit 3 is supported by the installation unit 18. The shaker unit 16 has the support state in which the shaker unit 16 is supported only by the installation unit 18 or the movable state in which the shaker unit 16 is slidable in the front-rear direction, and is supported only by the pair of wheels 25 of the installation unit 18.

The shaker unit 16 has the pair of wheels 25 at the rear side thereof. When the shaker unit 16 is in the movable state (the installation orientation), the wheel 25 is in contact with the slide surface 31*a* of the installation unit 18, and thereby the worker is able to readily slide the shaker unit 16 in the front-rear direction in the state in which the shaker unit 16 is supported by the installation unit 18 only via the pair of wheels 25. Therefore, the worker switches the shaker unit 16 in the support state (the installed orientation) to the movable state (the installation orientation), draws the shaker unit 16 to the front side, and thereby is able to be readily detach the shaker unit 16 from the bag making and packaging unit 3. Moreover, the worker places the rear-side end portion of the shaker unit 16 on the slide surface 31*a* of the installation unit 18, pushes the shaker unit 16 to the rear side, and thereby is readily able to attach the shaker unit 16 to the bag making and packaging unit 3.

The shaker unit 16 is typically a heavy object manufactured of steel, an alloy or the like having high strength and dimensional precision. In the case in which an action unit such as the shaker unit 16 of the present embodiment is attached to a conventional bag making and packaging unit that does not include the installation unit 18 of the present embodiment, the worker needs to keep holding the action unit, which is a heavy object, until the worker completely fixes the action unit to the bag making and packaging unit with bolts or the like.

However, in the present embodiment, when the worker attaches the shaker unit 16 to the installation unit 18, the worker places the pair of wheels 25 of the shaker unit 16 on the pair of slide surfaces 31*a* of the installation unit 18, slightly lifts the front-side end portion of the shaker unit 16, and thereby is able to readily push the shaker unit 16 to the rear side. Moreover, when the worker detaches the shaker unit 16 from the installation unit 18, the worker slightly lifts the front-side end portion of the shaker unit 16, and thereby is able to readily draw the shaker unit 16 to the front side. Then, after the worker has drawn the most part of the shaker unit 16 from the installation unit 18, the worker is able to lift the shaker unit 16 and detach the shaker unit 16 from the bag making and packaging unit 3. Consequently, the bag making and packaging machine 1 is able to lighten labor needed for the attachment and detachment of the detachable shaker unit 16 with respect to the bag making and packaging unit 3. The bag making and packaging machine 1 enables facilitation of an activity such as the replacement of the shaker unit 16, for example.

Moreover, the worker only slightly lifts the front side of the shaker unit 16 relative to the rear side of the shaker unit 16, and thereby is readily able to switch the shaker unit 16 from the support state to the movable state. Moreover, the worker, who have lifted and holds the front side of the shaker unit 16, only releases the front side of the shaker unit 16, and thereby is able to switch the shaker unit 16 from the movable state to the support state. Consequently, the bag making and packaging machine 1 enables facilitation of the attachment and detachment of the shaker unit 16.

Moreover, the shaker unit 16 in the support state is not be able to readily move in the front-rear direction because the wheels 25 are not in contact with the slide surfaces 31*a*. Therefore, when the shaker unit 16 in the support state is fixed to the installation unit 18 with bolts, unintended movement of the shaker unit 16 in the front-rear direction is able to be prevented. Consequently, the bag making and packaging machine 1 enables facilitation of an activity to fix the shaker unit 16 to the installation unit 18.

Moreover, the shaker unit 16 in the support state is fastened to the installation unit 18 with bolts via the fastening part 26. Consequently, the bag making and packaging machine 1 enables facilitation of an activity to fix of the shaker unit 16 to the installation unit 18.

Moreover, the air cylinder 28*a* of the drive actuator 28 of the shaker unit 16 has the connectors 28*b*. The connectors 28*b* are connected to the fitting 35 of the installation unit 18 with air pipes. The connectors 28*b* are attached to the front side of the drive actuator 28. The fitting 35 is a quick-connect fitting attached to the front side of the installation unit 18. Consequently, the bag making and packaging machine 1 enables facilitation of an activity to connect the connectors 28*b* of the shaker unit 16 to the fitting 35 of the installation unit 18 after the fixation of the shaker unit 16 to the installation unit 18. Moreover, the bag making and packaging machine 1 enables facilitation of an activity to separate the connectors 28*b* of the shaker unit 16 from the fitting 35 of the installation unit 18 before the detachment of the shaker unit 16 from the installation unit 18.

(8) Modification

The embodiment of the present invention is described above, but the present invention is not limited to the above embodiment, and various changes and modifications may be made without departing from the spirit and scope of the invention.

(8-1) Modification A

In the present embodiment, the bag making and packaging machine 1 includes the shaker unit 16 as a unit detachable from the bag making and packaging unit 3. The shaker unit 16 has the function of vibrating the tubular film Fc to impart vibration to the articles C to be packaged piled in the tubular film Fc and thereby reducing a pile of the articles C to be packaged. In the state in which the shaker unit 16 sandwiches the tubular film Fc with the pair of film vibration plates 22*b*, the vibration part 22 rotates about the rotational shaft 22*a*, and thereby the tubular film Fc vibrates upwardly and downwardly. However, the shaker unit 16 may vibrate the tubular film Fc using other methods.

Figure 13:
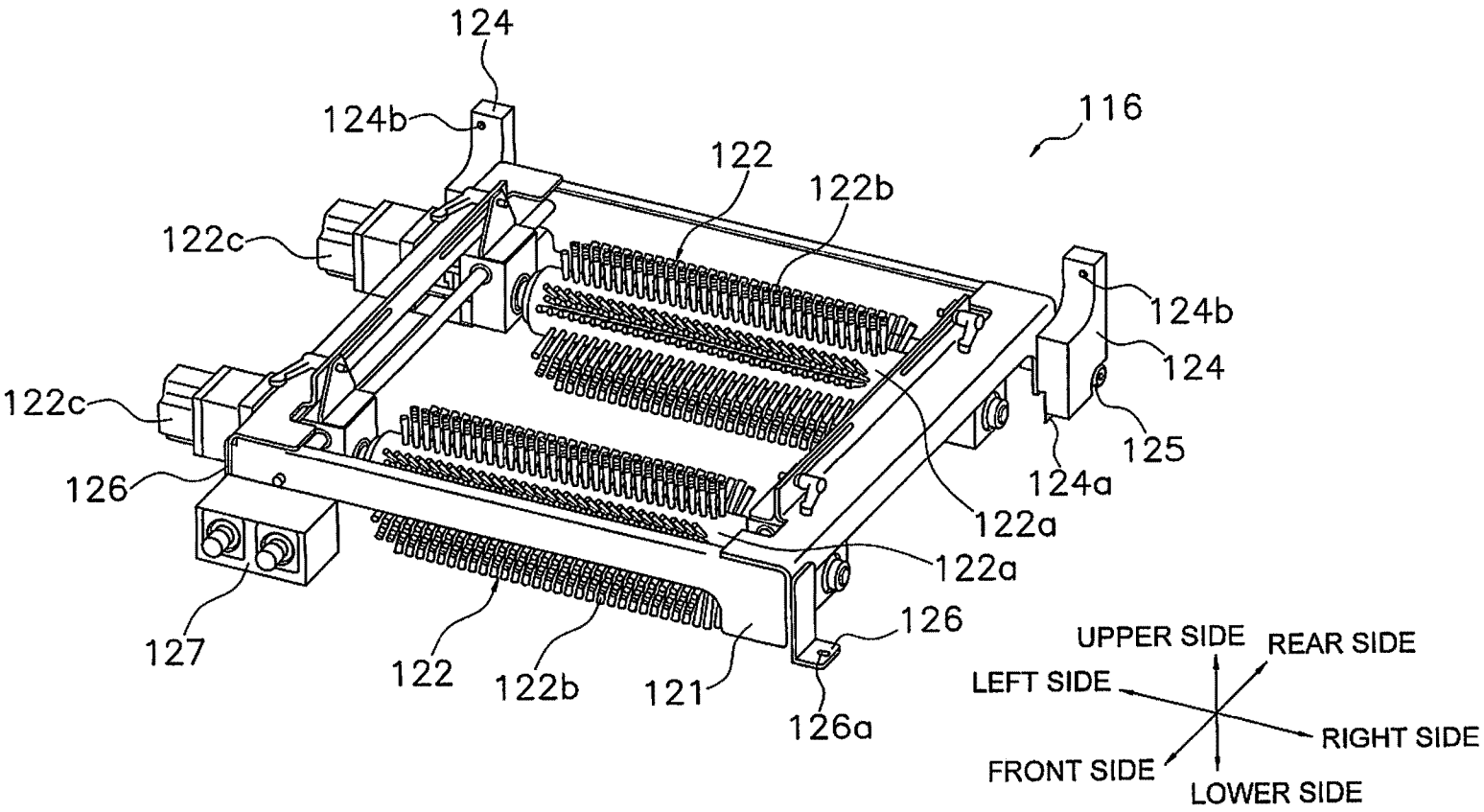
FIG. 13 is a perspective view of a shaker unit of modification A.
Figure 14:
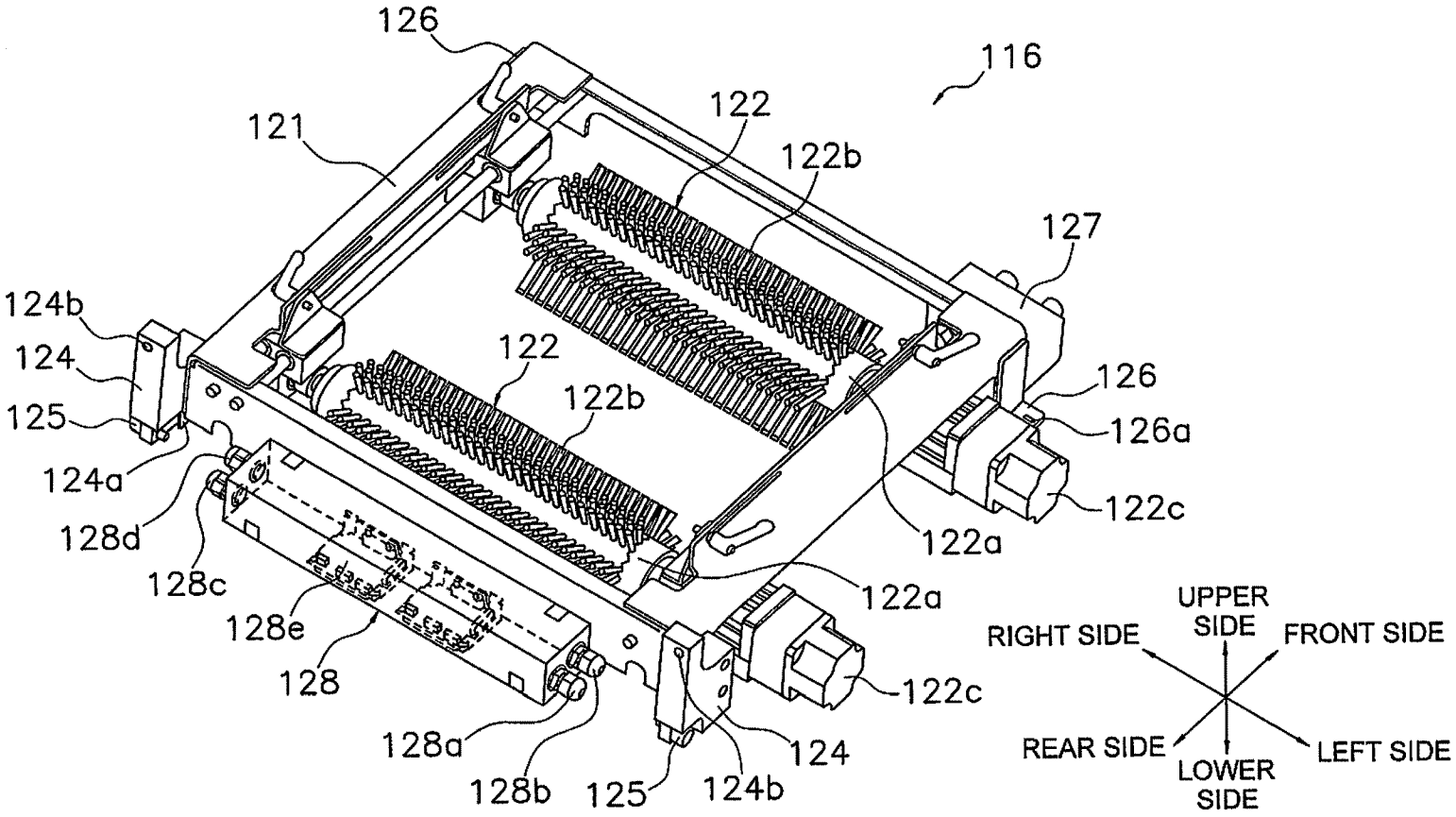
FIG. 14 is a perspective view of the shaker unit of modification A as seen from the rear side.
Figure 15:
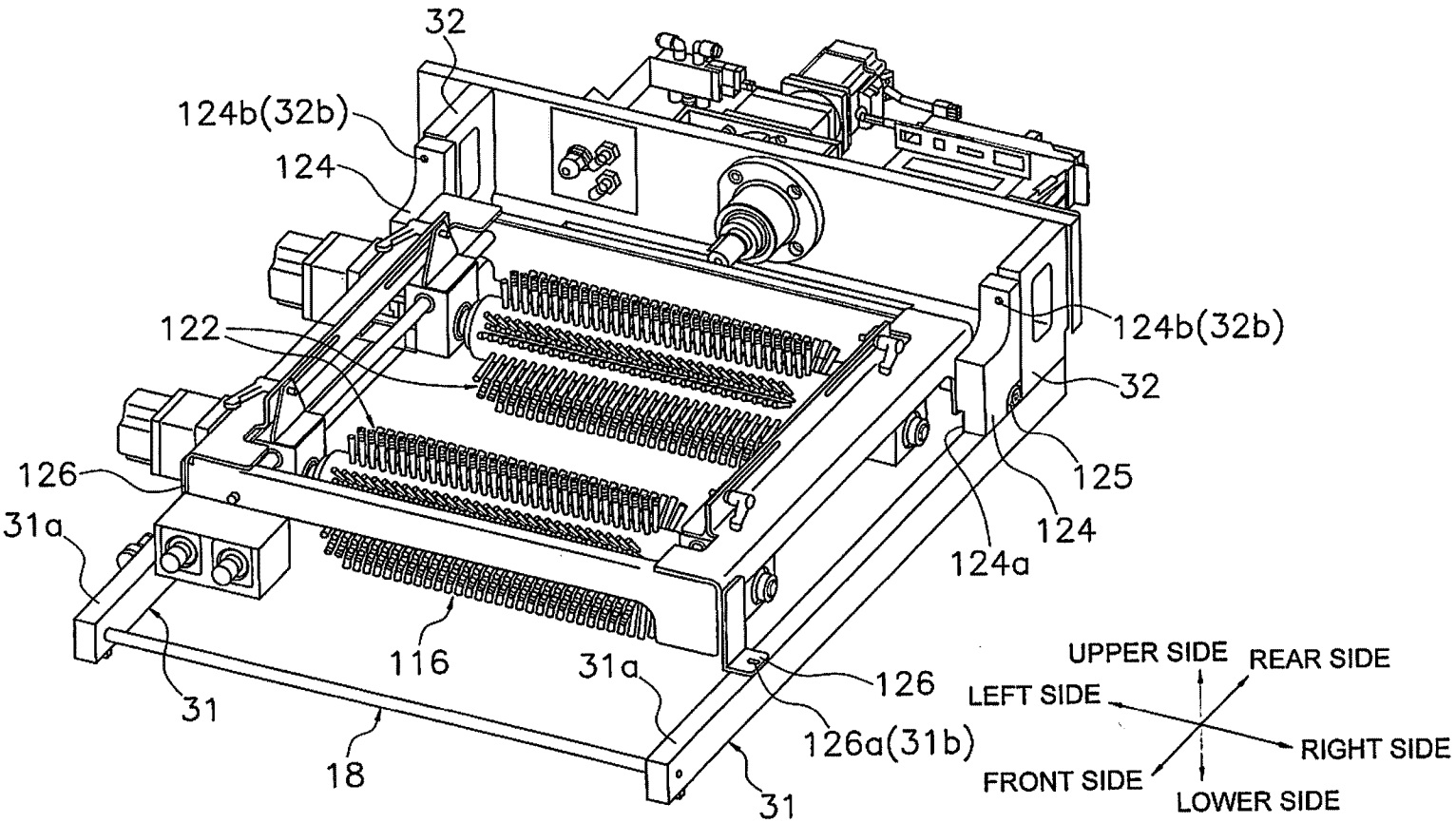
FIG. 15 is a perspective view of the shaker unit of modification A supported by the installation unit.

FIG. 13 is a perspective view of a shaker unit 116 of the present modification. FIG. 14 is a perspective view of the shaker unit 116 as seen from the rear side. FIG. 15 is a perspective view of the shaker unit 116 supported by the installation unit 18. The installation unit 18 is the same as the installation unit 18 of the present embodiment. In the present modification, components excluding the shaker unit 116 are the same corresponding components of the present embodiment. The shaker unit 116 will be primarily described, and same matters as those of the present embodiment will be omitted.

The shaker unit 116 is primarily configured with a frame 121, two brush units 122, a pair of wheel stops 124, a pair of wheels 125, and a pair of fastening parts 126, a controller 127, and a wiring unit 128.

The frame 121 is a member corresponding to a main body of the shaker unit 116. Other components of the shaker unit 116 are attached to the frame 121.

The two brush units 122 are members spaced in the front-rear direction and attached to the frame 121. The brush unit 122 is primarily configured with a rotational shaft 122*a*, a number of brushes 122*b*, and a motor 122*c*. The rotational shaft 122*a* is rotatably attached to the frame 121 so as to extend in the left-right direction. The brushes 122*b* are arranged on the periphery of the rotational shaft 122*a*. All of the brushes 122*b* arranged in the left-right direction have the same length. On the other hand, the brushes 122*b* arranged in the peripheral direction of the rotational shaft 122*a* have a length different from each other. The motor 122*c* is attached to the left side of the frame 121. The motor 122*c* rotates the rotational shaft 122*a*.

The pair of wheel stops 124 are members attached to both left and right end portions of the frame 121 at the rear side of the frame 121. A guide plate 124*a* is attached to each of the wheel stops 124. Each guide plate 124*a* is attached to a left-side side surface of the right-side wheel stop 124 and a right-side side surface of the left-side wheel stop 124. The wheel stops 124 each have a through hole 124*b*. The through hole 124*b* is made at the upper portion of the wheel stop 124. The through hole 124*b* corresponds to the through hole 23*a* of the present embodiment, and the through holes 124*b* are used together with the bolt holes 32*b* of the installation unit 18 to fix the shaker unit 116 to the installation unit 18 with bolts.

The pair of wheels 125 are members supported by the pair of wheel stops 124. The wheel 125 is a roller having a rotational shaft in the left-right direction, and is able to rotate in the front-rear direction. In FIG. 13, only the right-side wheel 125 is illustrated.

The pair of fastening parts 126 are members attached to both left and right sides of the frame 121 at the front side of the frame 121. The fastening part 126 is a plate having an L-shape. The fastening part 126 has one through hole 126*a*. As illustrated in FIG. 13, the through hole 126*a* is made in a portion parallel to a horizontal surface of the fastening part 126. The through hole 126*a* corresponds to the through hole 26*a* of the present embodiment, and the through holes 126*a* are used together with the bolt holes 31*b* of the installation unit 18 to fix the shaker unit 116 to the installation unit 18 with bolts.

The controller 127 is a member attached to a front surface of the frame 121. The controller 127 is an adjustment knob and the like for adjusting rotational speeds of the rotational shafts 122*a* of the brush units 122.

The wiring unit 128 is a unit to which wires of the shaker unit 116 are connected. As illustrated in FIG. 14, the wiring unit 128 is primarily configured with a first connector 128*a*, a second connector 128*b*, a third connector 128*c*, a fourth connector 128*d*, and control boards 128*e*. The first connector 128*a* and the second connector 128*b* are connected to the respective motors 122*c* of the two brush units 122. The third connector 128*c* is connected to the controller 127. The fourth connector 128*d* is connected to an external power source (not illustrated). The control board 128*e* has the function of controlling a rotational speed of the brush units 122 on the basis of an operation with respect to the controller 127, for example. In FIG. 14, the wires connected to the wiring unit 128 are omitted.

In the present modification, the shaker unit 116 vibrates the tubular film Fc passing between the two brush units 122. When the tubular film Fc passes between the two brush units 122, and when the brush units 122 rotate about the rotational shaft 122*a*, the brushes 122*b* of the brush units 122 repeatedly collide with the tubular film Fc, and thereby the tubular film Fc vibrates.

Moreover, the shaker unit 116 is able to be attached to the installation unit 18 and detached from the installation unit 18 using the same methods as the shaker unit 16 of the present embodiment. That is, when the worker attaches the shaker unit 116 to the installation unit 18, the worker places the pair of wheels 125 of the shaker unit 116 on the pair of slide surfaces 31*a* of the installation unit 18, slightly lifts the front-side end portion of the shaker unit 116, and thereby is able to readily push the shaker unit 116 to the rear side. Moreover, when the worker detaches the shaker unit 116 from the installation unit 18, the worker slightly lifts the front-side end portion of the shaker unit 116, and thereby is able to readily draw the shaker unit 116 to the front side. Then, after the worker has drawn the most part of the shaker unit 116 from the installation unit 18, the worker is able to lift the shaker unit 116 and detach the shaker unit 116 from the bag making and packaging unit 3. Consequently, the bag making and packaging machine 1 including the shaker unit 116 according to the present modification is able to lighten labor needed for the attachment and detachment of the detachable shaker unit 116 with respect to the bag making and packaging unit 3.

(8-2) Modification B

In the present embodiment, the bag making and packaging machine 1 includes the shaker unit 16 as a unit detachable from the bag making and packaging unit 3. The shaker unit 16 has the function of vibrating the tubular film Fc to impart vibration to the articles C to be packaged piled in the tubular film Fc and thereby reducing a pile of the articles C to be packaged.

However, the bag making and packaging machine 1 may include an action unit having other functions. The action unit has the function of acting on the tubular film Fc and thereby improving a state of the tubular film Fc. Moreover, the action unit is a unit detachable from the bag making and packaging unit 3. The bag making and packaging machine 1 may include such an action unit instead of or together with the shaker unit 16.

What is claimed is:

1. A bag making and packaging machine comprising:

a former configured to form a packaging material into a tubular shape and thereafter move the packaging material formed into a tubular shape in a first direction;

a transverse sealing mechanism installed below the former and configured to seal the packaging material formed into a tubular shape in a transverse direction that is transverse to the first direction;

an action part detachable and configured to act on the packaging material formed into a tubular shape to improve a state of the packaging material; and an installation part configured to install the action part below the former and above the transverse sealing mechanism, the installation part having a guide having a slide surface configured to receive and support the action part such that the action part slides on the slide surface during installation in a horizontal direction, and a drive part configured to transmit a force to the action part the action part having a coupling part configured to couple to the drive part.

2. The bag making and packaging machine according to claim 1, wherein the action part has at least one wheel configured to rotate while contacting the slide surface when the action part slides in the horizontal direction.

3. The hag making and packaging machine according to claim 2, wherein the action part is configured such that in a first state the action part is supported only by the installation part and in a second state the action part is slidable by a worker in the horizontal direction and a portion thereof is supported by the installation part, and the wheel is not in contact with the slide surface with the action part in the first state, and the wheel is in contact with the slide surface with the action part in the second state.

4. The bag making and packaging machine according to claim 3, wherein the action part has:

the wheel configured to rotate in a direction in which the action part slides when the action part is mounted on the installation part; and a fastening part attached to a location different from the wheel, and the fastening part is able to be fastened to the installation part with the action part the first state.

5. The bag making and packaging machine according to claim 3, wherein the action part is inclined and thereby is able to be switched from the first state to the second state.

6. The bag making and packaging machine according to claim 1, wherein the action part has a connector attached to a side opposite to a direction in which the action part slides when the action part is mounted on the installation part, and the connector is connected to a drive actuator of the action part.

7. The hag making and packaging machine according to claim 1, wherein the action part is a shaker unit vibrating the packaging material in a tubular shape.

8. The bag making and packaging machine according to claim 1, wherein the coupling part is configured to be coupled to the drive part by pushing the action part to the drive part.

* * * * *